US012729888B2

(12) United States Patent
Chen et al.

(10) Patent No.: US 12,729,888 B2
(45) Date of Patent: Sep. 8, 2026

(54) COOLANT REFRESH DEVICE FOR COOLANT DISTRIBUTION UNIT

(71) Applicant: Cisco Technology, Inc., San Jose, CA (US)

(72) Inventors: Yongguo Chen, Shanghai (CN); Vic Hong Chia, Sunnyvale, CA (US); Hua Yang, Tracy, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 115 days.

(21) Appl. No.: 18/532,691

(22) Filed: Dec. 7, 2023

(65) Prior Publication Data

US 2025/0189181 A1 Jun. 12, 2025

(51) Int. Cl.
*F25B 25/00* (2006.01)
*F25B 41/40* (2021.01)

(52) U.S. Cl.
CPC ..... *F25B 25/005* (2013.01); *F25B 41/40* (2021.01); *F25B 2345/001* (2013.01); *F25B 2345/002* (2013.01); *F25B 2400/21* (2013.01); *F25B 2500/05* (2013.01)

(58) Field of Classification Search
CPC .. F25B 25/005; F25B 41/40; F25B 2345/001; F25B 2345/002; F25B 2400/21; F25B 2500/05
See application file for complete search history.

(56) References Cited

U.S. PATENT DOCUMENTS 10,905,030 B1 * 1/2021 Fernandes ..... H05K 7/20836
11,310,939 B2 * 4/2022 Ye ..... H05K 7/20272
2018/0027698 A1 * 1/2018 Cader ..... H05K 7/20272 165/80.4
2019/0182988 A1 * 6/2019 Lunsman ..... H05K 7/20281
2022/0248570 A1 * 8/2022 Chen ..... H05K 7/20272
(Continued)

FOREIGN PATENT DOCUMENTS

CN 115915701 A 4/2023
CN 116528567 A 8/2023

OTHER PUBLICATIONS

Nidec Dorporation: "Coolant Distribution Units (CDU = water—cooling system) to respond to growing thermal loads", https://www.nidec.com/en/technology/casestudy/liquid-cooling/, Aug. 26, 2022, 7 pages.

(Continued)

*Primary Examiner* — David J Teitelbaum

(74) *Attorney, Agent, or Firm* — Edell, Shapiro & Finnan, LLC

(57) ABSTRACT

In some embodiments, an apparatus includes a housing of a coolant distribution unit, a pump of the coolant distribution unit configured to circulate coolant between the coolant distribution unit and an external component, and a coolant refresh device of the coolant distribution unit. The coolant refresh device is configured to direct coolant from a coolant source into the coolant distribution unit and to discharge coolant out of the coolant distribution unit, and the pump and the coolant refresh device are interchangeably implementable in the housing such that the pump and the coolant refresh device are configured to swap and replace one another in the housing to install one of the pump or the coolant refresh device in the housing at a time.

20 Claims, 6 Drawing Sheets

(56) References Cited

U.S. PATENT DOCUMENTS

| | | | | |
|---|---|---|---|---|
| 2022/0330459 | A1* | 10/2022 | Chen | H05K 7/20272 |
| 2022/0346271 | A1 | 10/2022 | Chen et al. | |
| 2023/0142053 | A1 | 5/2023 | Archibald | |
| 2024/0057285 | A1* | 2/2024 | Liang | H05K 7/20645 |

OTHER PUBLICATIONS

Sun R., et al., "White Paper: An Advanced Liquid Cooling Rack Design for Data Center", Open Compute Project, May 5, 2021, 23 pages.

Boyd Corporation, "Coolant Distribution Units (CDU) for Data Center Cooling", Aug. 12, 2023, 19 pages.

* cited by examiner

COOLANT REFRESH DEVICE FOR COOLANT DISTRIBUTION UNIT

TECHNICAL FIELD

The present disclosure relates to a coolant distribution unit (CDU).

BACKGROUND

A coolant distribution unit (CDU) provides cooling to an electrical component, device, and/or system, such as a server. The CDU may circulate a coolant, such as from the CDU to an electrical component, where the coolant absorbs heat from the electrical component, and from the electrical component to the CDU. The CDU may remove the absorbed heat from the coolant, thereby placing the coolant in condition to provide additional cooling capabilities. The cooling of the electrical component by the CDU may enable the electrical component to operate desirably and/or may maintain a structural integrity of the electrical component. Thus, continued operation of the CDU to cool the electrical component is desirable. That is, any downtime of the CDU reduces cooling of the electrical component and may negatively affect an operation and/or a structural integrity of the electrical component. As such, improvements of the CDU to reduce or limit downtime of the CDU, such as to add, remove, and/or replace coolant in the CDU, may provide benefits related to the operation and/or the structural integrity of one or more electrical components that produce heat during operation.

DETAILED DESCRIPTION

Overview

The present disclosure is directed to a coolant distribution unit. In some aspects, the techniques described herein relate to an apparatus including: a housing of a coolant distribution unit; a pump of the coolant distribution unit, wherein the pump is configured to circulate coolant between the coolant distribution unit and an external component; and a coolant refresh device of the coolant distribution unit, wherein the coolant refresh device is configured to direct coolant from a coolant source into the coolant distribution unit and to discharge coolant out of the coolant distribution unit, and the pump and the coolant refresh device are interchangeably implementable in the housing such that the pump and the coolant refresh device are configured to swap and replace one another in the housing to install one of the pump or the coolant refresh device in the housing at a time.

EXAMPLE EMBODIMENTS

Figure 1:
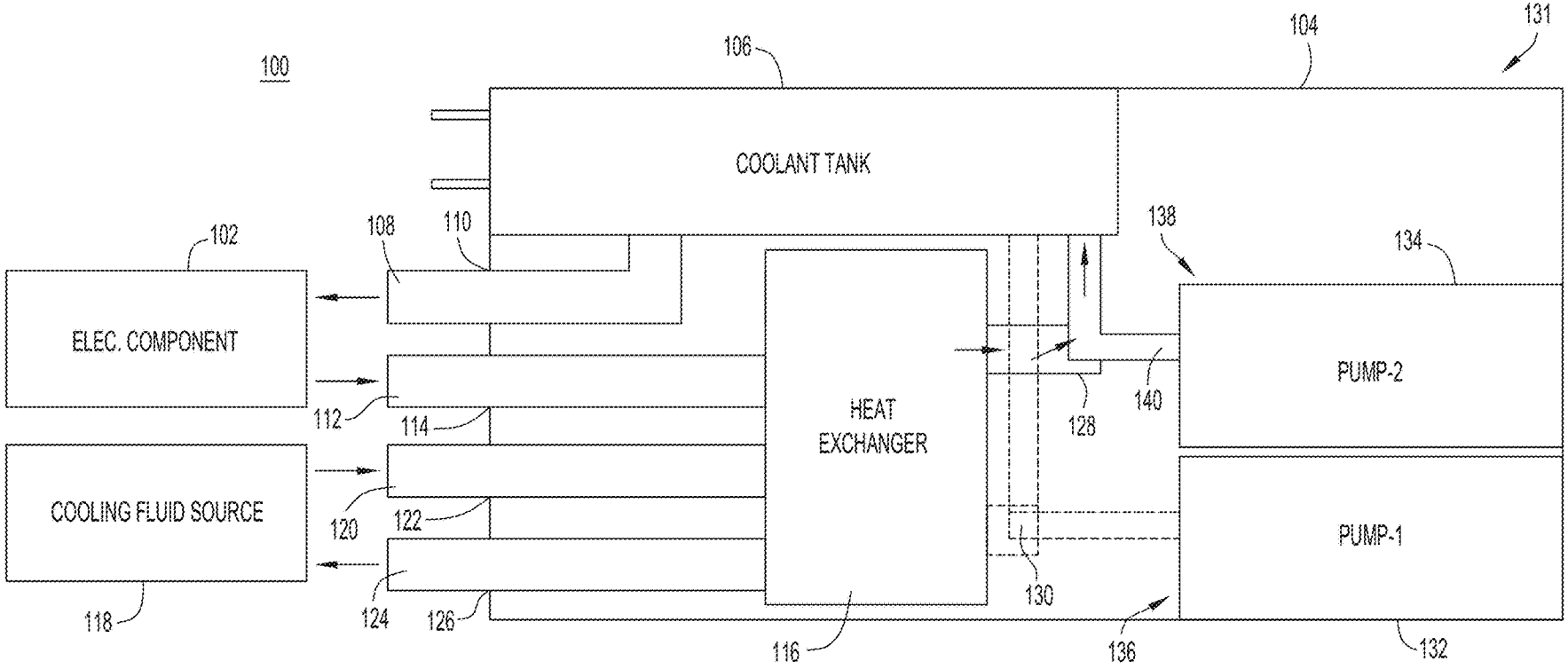
FIG. 1 is a schematic diagram of a coolant distribution unit operating in a first configuration, according to an example embodiment.

With reference made to FIG. 1, depicted therein is a coolant distribution unit (CDU) 100 configured to provide cooling to a separate electrical component 102, such as a server and/or a processor. For example, the CDU 100 may include a CDU housing or enclosure 104 in which a coolant tank or reservoir 106 may be disposed. The coolant tank 106 may be configured to store or hold a coolant, which circulates between the CDU 100 and the electrical component 102 to cool the electrical component 102 that is external to the CDU housing 104. For instance, a first coolant conduit, pipe, or tubing 108 may extend from the coolant tank 106 to the electrical component 102 via a first CDU outlet 110 formed through the CDU housing 104. The first coolant conduit 108 may be configured to direct coolant from the coolant tank 106 to the electrical component 102, where the coolant may absorb heat from the electrical component 102, thereby cooling the electrical component 102 and heating the coolant. A second coolant conduit, pipe, or tubing 112 extending through a first CDU inlet 114 formed through the CDU housing 104 may be configured to direct the heated coolant from the electrical component 102 into the CDU housing 104, where the heated coolant may be cooled to place the coolant in condition to absorb heat from the electrical component 102 again.

In the illustrated embodiment, the CDU 100 includes a heat exchanger 116 disposed within the CDU housing 104. The second coolant conduit 112 may extend to the heat exchanger 116 and may direct coolant to the heat exchanger 116. The heat exchanger 116 may be configured to reduce a temperature of the coolant. By way of example, the heat exchanger 116 may be fluidly coupled to a cooling fluid source 118 and is configured to receive a cooling fluid (e.g., cold water) from the cooling fluid source 118 and place the cooling fluid in a heat exchange relationship with the coolant to cause heat transfer from the coolant to the cooling fluid, thereby reducing a temperature of the coolant. To this end, a first cooling fluid pipe, tubing, or conduit 120 may extend through a second CDU inlet 122 of the CDU housing 104 and may direct cooling fluid from the cooling fluid source 118 to the heat exchanger 116. A second cooling fluid conduit, pipe, or tubing 124 may extend through a second CDU outlet 126 of the CDU housing 104 and may direct heated cooling fluid from the heat exchanger 116 out of the CDU housing 104, such as back toward the cooling fluid source 118. In additional or alternative embodiments, the heat exchanger 116 may be configured to reduce a temperature of the coolant using another technique, such as by directing an airflow over the coolant to discharge heat from the coolant via convection. After being cooled via the heat exchanger 116, the coolant may flow to the coolant tank 106. For instance, a port 128 and a third coolant conduit, pipe, or tubing 130 may fluidly couple the heat exchanger 116 to the coolant tank 106.

In the illustrated embodiment, the CDU 100 is in a first configuration 131 in which a first pump 132 (e.g., a stationary pump) and a second pump 134 (e.g. a removable pump) are disposed in the CDU housing 104. By way of example, the CDU housing 104 may include a first slot 136 in which the first pump 132 may be positioned and a second slot 138 in which the second pump 134 may be positioned. The first pump 132 may be configured to direct coolant (e.g., cooled coolant) from the heat exchanger 116 to the coolant tank 106 via the third coolant conduit 130, and the second pump 134 may be configured to direct coolant (e.g., cooled coolant) from the heat exchanger 116 to the coolant tank 106 via the port 128. Coolant flow from the heat exchanger 116 to the coolant tank 106 may also drive coolant flow from the coolant tank 106 toward the electrical component 102 via the first coolant conduit 108. Thus, in the first configuration 131, operation of either the first pump 132 or the second pump 134 may enable cooling of the electrical component 102 via the coolant. In certain embodiments, both the first pump 132 and the second pump 134 may operate in the first configuration 131 to direct coolant to the electrical component 102.

The second pump 134 may be readily removed from the CDU housing 104, such as manually by an operator or a technician. By way of example, the second pump 134 may be readily decoupled from the port 128 to enable the second pump 134 to be moved out the second slot 138 and out of the CDU housing 104. For instance, the second pump 134 may include a pump interface 140 configured to couple to (e.g., insert into) the port 128 via a quick connector. Coupling of the pump interface 140 to the port 128 may enable operation of the second pump 134 to direct coolant from the heat exchanger 116 to the coolant tank 106 via the port 128. For example, the pump interface 140 may sealingly engage with the port 128 to direct coolant from the heat exchanger 116 to the coolant tank 106 and avoid leakage of coolant from the port 128. Decoupling of the pump interface 140 from the port 128 may prevent operation of the second pump 134 from directing coolant from the heat exchanger 116 to the coolant tank 106. As discussed herein, removal of the second pump 134 from the CDU housing 104 may transition the CDU 100 from the first configuration 131 to a second configuration.

Figure 2:
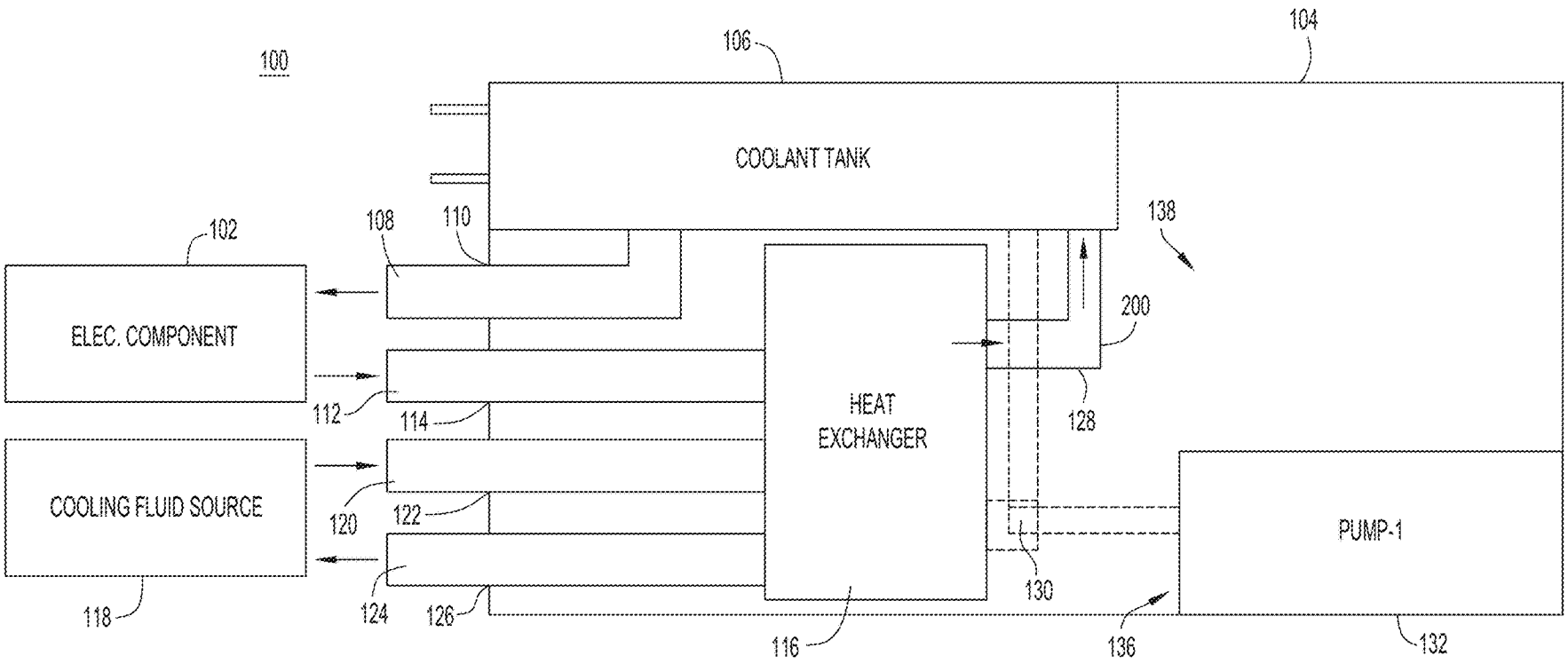
FIG. 2 is a schematic diagram of the coolant distribution unit of FIG. 1 transitioning from the first configuration to a second configuration, according to an example embodiment.

FIG. 2 is a schematic diagram of the CDU 100 in transition from the first configuration 131 to a second configuration. For example, in the illustrated embodiment, the second pump 134 is removed from the CDU housing 104 to enable a new device to be positioned in the second slot 138 in the second configuration. Thus, no other device is coupled to the port 128 and the second slot 138 within the CDU housing 104 is unoccupied during transition from the first configuration 131 to the second configuration. While the second slot 138 is unoccupied (e.g., while no device directs coolant from the heat exchanger 116 to the coolant tank 106 via the port 128), the first pump 132 may operate to direct coolant from the heat exchanger 116 to the coolant tank 106 via the third coolant conduit 130. Consequently, coolant may continue to flow from the heat exchanger 116 to the coolant tank 106, as well as from the coolant tank 106 to the electrical component 102, while the second slot 138 is unoccupied. In this manner, the first pump 132 may operate to enable the CDU 100 to continue to cool the electrical component 102 regardless of whether coolant is directed from the heat exchanger 116 to the coolant tank 106 via the port 128 (e.g., by operating the second pump 134).

In some embodiments, the first pump 132 may be a variable speed pump configured to operate at different speeds, and the first pump 132 may be configured to operate at an increased speed while the second slot 138 is unoccupied to direct coolant to the electrical component 102 at a sufficient flow rate. For example, in the first configuration 131 in which the second pump 134 may operate to direct coolant to the electrical component 102, the first pump 132 may operate at a relatively lower speed to enable coolant flow to the electrical component 102 at a target flow rate. While the second slot 138 is unoccupied and no device is directing coolant from the heat exchanger 116 to the coolant tank 106 (e.g., and to the electrical component 102) via the port 128, the first pump 132 may operate at a relatively higher speed to continue to enable coolant flow to the electrical component 102 at the target flow rate. Thus, although the first pump 132 may operate both while the second slot 138 is unoccupied and while the second pump 134 is in operation, the speed of the first pump 132 may be adjusted to achieve a target flow rate of coolant flow to the electrical component 102.

In certain embodiments, the port 128 is configured to block coolant leakage out of the port 128 during transition between the first configuration 131 and the second configuration of the CDU 100. For example, the port 128 may include a wall 200 that is movable (e.g., rotatable). In the first configuration 131, the wall 200 may be moved to provide an opening in the port 128 that enables insertion of the pump interface 140 of the second pump 134 into the port 128 and enables the second pump 134 to direct coolant from the heat exchanger 116 to the coolant tank 106. Upon removal of the pump interface 140 from within the port 128 to remove the second pump 134 from the CDU housing 104, the wall 200 may be moved to close the opening in the port 128 to block leakage of coolant out of the port 128. As an example, a biasing member may be configured to bias the wall 200 to close the opening absent a sufficient force imparted onto the wall 200 (e.g., by the pump interface 140 for insertion into the port 128).

Figure 3:
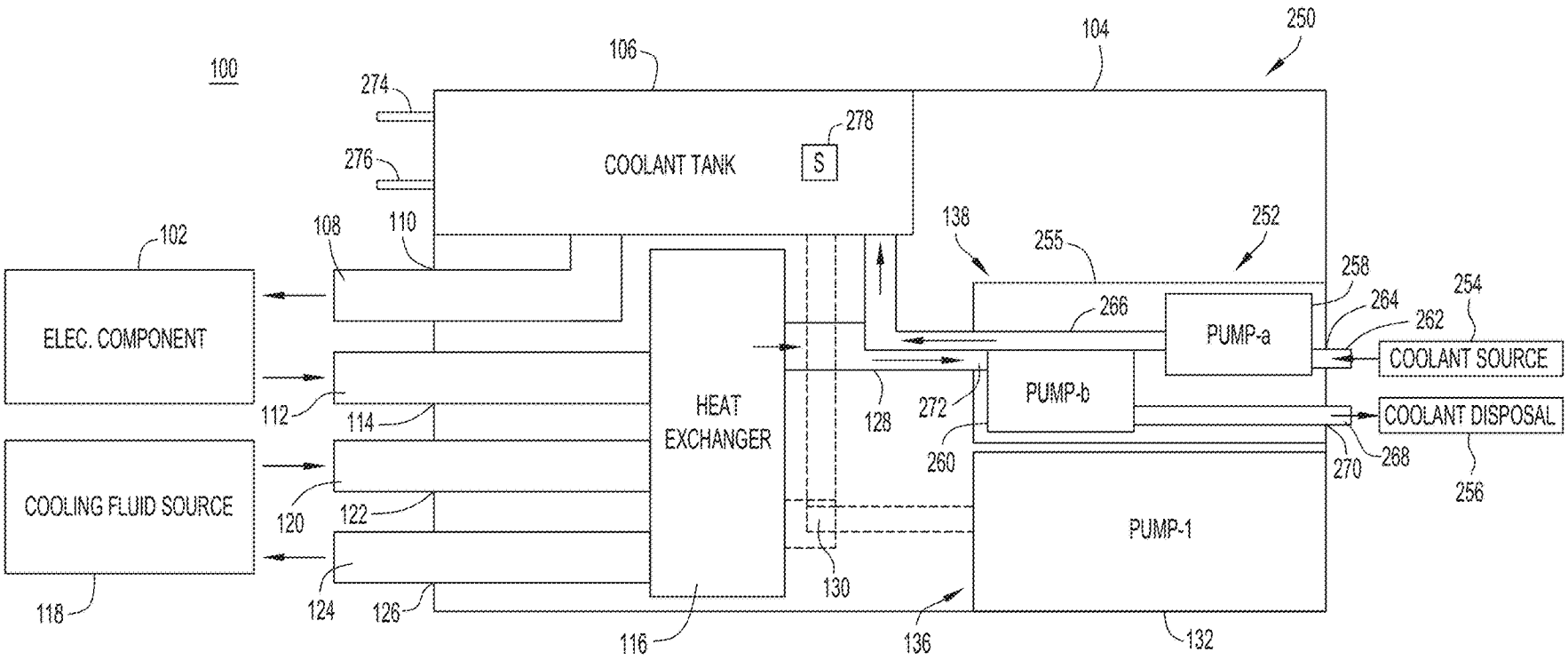
FIG. 3 is a schematic diagram of the coolant distribution unit of FIG. 1 operating in a second configuration, according to an example embodiment.

FIG. 3 is a schematic diagram of the CDU 100 in a second configuration 250 in which a coolant refresh device (CRD) 252 is positioned in the second slot 138. The CRD 252 may be configured to direct coolant from a coolant source 254 into the CDU 100 and to discharge coolant out of the CDU 100 into a coolant disposal location 256. That is, the CRD 252 may be configured to add coolant to the CDU 100 and to remove coolant from the CDU 100. By way of example, the CRD 252 may be configured to replace old or used coolant with new coolant to refresh the coolant supply in the CDU 100. For instance, operation of the CDU 100 to cool the electrical component 102 via the coolant may cause the coolant to become contaminated or otherwise reduce effectiveness of the coolant to provide cooling of the electrical component 102. The coolant source 254 may include new coolant that is relatively more effective for providing cooling of the electrical component 102. For this reason, and the CRD 252 may operate to replace the relatively less effective coolant within the CDU 100 with new, relatively more effective coolant from the coolant source 254 to improve operation of the CDU 100. In some embodiments, the coolant disposal location 256 may include a process used to improve effectiveness of the coolant, such as by removing contaminants from the coolant. Thus, the coolant discharged from the CDU 100 to the coolant disposal location 256 may become reusable and recycled (e.g., provided to the coolant source 254 to be directed back into the CDU 100). Additionally or alternatively, the coolant disposal location 256 may include a process to expel the coolant to a different environment and avoid reusage of the coolant.

The CRD 252 may include a CRD housing 255 configured to occupy the second slot 138. For example, a shape and/or size of the CRD housing 255 may be substantially similar to that of the second pump 134 such that the CRD 252 may be readily positioned in the second slot 138 without further modifying the CDU 100 (e.g., modifying the CDU housing 104 to adjust the size of the second slot 138). Thus, the second slot 138 may be configured to individually receive the second pump 134 and the CRD 252. In addition, the CRD 252 may also be configured to couple to the port 128 to circulate coolant through the CDU 100 (e.g., between the coolant tank 106 and the heat exchanger 116). That is, the second pump 134 and the CRD 252 may be configured to interchangeably couple to the port 128 and therefore to interchangeably fluidly couple to the first coolant conduit 108. In this way, the second pump 134 and the CRD 252 may be interchangeably implementable in the CDU housing 104 to, during operation of the CDU 100 (i.e., uptime), swap and replace one another in the CDU housing 104 and install one of the second pump 134 or the CRD 252 in the second slot 138 at a time.

The CRD 252 may include a first CRD pump 258 and a second CRD pump 260 disposed in the CRD housing 255. The first CRD pump 258 may be configured to direct coolant from the coolant source 254 toward the coolant tank 106 to direct new coolant into the CDU 100, and the second CRD pump 260 may be configured to direct coolant from the heat exchanger 116 toward the coolant disposal location 256 to direct old coolant out of the CDU 100. To this end, the CRD 252 may include a first CRD conduit 262 (e.g., a first CRD inlet conduit, a first CRD inlet) extending from the first CRD pump 258, through a third CDU inlet 264 formed in the CDU housing 104, to the coolant source 254 to fluidly couple the first CRD pump 258 and the coolant source 254 to one another. The CRD 252 may also include a second CRD conduit 266 (e.g., a first CRD outlet conduit, a first CRD outlet) extending from the first CRD pump 258 to the port 128 to fluidly couple the first CRD pump 258 to the port 128 and to the coolant tank 106. Thus, the first CRD pump 258 may be configured to direct coolant from the coolant source 254 to the coolant tank 106 via the first CRD conduit 262, the second CRD conduit 266, and the port 128. The CRD 252 may additionally include a third CRD conduit 268 (e.g., a second CRD outlet conduit, a second CRD outlet) extending from the second CRD pump 260, through a third CDU outlet 270, and to the coolant disposal location 256 to fluidly couple the second CRD pump 260 and the coolant disposal location 256 to one another. The CRD 252 may further include a fourth CRD conduit 272 (e.g., a second CRD inlet conduit, a second CRD inlet) extending from the port 128 to the second CRD pump 260 to fluidly couple the second CRD pump 260 to the port 128 and to the heat exchanger 116. As such, the second CRD pump 260 may be configured to direct coolant from the heat exchanger 116 to the coolant disposal location 256 via the port 128, the fourth CRD conduit 272, and the third CRD conduit 268.

In the second configuration 250, operation of the first CRD pump 258 of the CRD 252 may direct coolant to the electrical component 102. Thus, while the CRD 252 operates to refresh coolant in the CDU 100, the CDU 100 may continue to cool the electrical component 102. As such, the CDU 100 may cool the electrical component 102 via the second pump 134 in the first configuration 131, via the first pump 132 during transition from the first configuration 131 to the second configuration 250, and via the CRD 252 in the second configuration 250. In this manner, the second pump 134 and the CRD 252 are interchangeably hot swappable in that the CDU 100 may continue to operate to cool the electrical component 102 via the coolant while the second pump 134 and the CRD 252 are being removed/inserted to replace one another. That is, at any given time, at least one of the first pump 132, the second pump 134, or the CRD 252 may operate to direct coolant to the electrical component 102. In certain embodiments, the first CRD pump 258 of the CRD 252 may have a similar specification as that of the second pump 134 to enable the CDU 100 to direct coolant in a similar manner to the electrical component 102 in the first configuration 131 and in the second configuration 250. For example, the second pump 134 and the CRD 252 may operate to direct coolant to the electrical component 102 at a similar flow rate, at a similar flow speed, at a similar flow pressure, and the like. Moreover, the CRD 252 may be compatible with the same control scheme used to operate the second pump 134, such as to utilize the same power, control strategy, and so forth, to direct coolant in a similar manner. Thus, the CRD 252 may readily operate upon installation to cool the electrical component 102.

In some embodiments, the first pump 132 may also operate to direct coolant to the electrical component 102 in the second configuration 250. For example, the first pump 132 may operate at a lower speed in the second configuration 250 relative to an operational speed in the configuration of the CDU 100 shown in FIG. 2 (e.g., while operation of the CRD 252 is suspended). The speed of the first pump 132 in the second configuration 250 may be substantially similar to or substantially different from the speed of the first pump 132 in the first configuration 131. In this manner, the first pump 132 may be selectively operated at a particular speed that directs coolant to the electrical component 102 more suitably.

The illustrated CDU 100 also includes a first tank conduit 274 and a second tank conduit 276 fluidly coupled to the coolant tank 106. The first tank conduit 274 and the second tank conduit 276 may also be used to refresh the coolant supply of the CDU 100. For instance, one of the first tank conduit 274 or the second tank conduit 276 may be used to drain coolant directly from the coolant tank 106 (e.g., to the coolant disposal location 256), and another of the first tank conduit 274 or the second tank conduit 276 may be used to directly re-fill the coolant tank 106 (e.g., via coolant from the coolant source 254). Thus, in addition to or as an alternative to operation of the CRD 252, coolant may be removed and/or added to the coolant tank 106 via the first tank conduit 274 and/or the second tank conduit 276.

It should be noted that simultaneous operation of the first CRD pump 258 and of the second CRD pump 260 of the CRD 252 to refresh the coolant supply of the CDU 100 while continuing to direct coolant to the electrical component 102 may cause new coolant from the coolant source 254 to mix with existing coolant in the CDU 100. For example, the new coolant may combine with the existing coolant within the coolant tank 106, and the combined coolant may be directed to the electrical component 102 and then to the heat exchanger 116. Thus, the CRD 252 may also discharge a mixture of new coolant and existing coolant from the heat exchanger 116 to the coolant disposal location 256. For this reason, the CRD 252 may not fully replace existing coolant with new coolant from the coolant source 254. Instead, the CRD 252 may operate to replace a certain amount of coolant previously circulating through the CDU 100, such as to achieve a threshold amount (e.g., a composition of between 40% to 50% by volume of a total volume of coolant) of new coolant in the CDU 100. As an example, the CRD 252 may continue to operate for a predetermined or preset duration of time to achieve the threshold amount of new coolant. As another example, the CRD 252 may operate until a threshold level of a parameter of coolant circulating through the CDU 100 has been achieved. For instance, the CDU 100 may include a sensor 278 (e.g., positioned in the coolant tank 106, positioned in any of the coolant conduits 108, 112, positioned in the port 128) configured to determine the parameter, which may include a chemical composition of the coolant, a transparency of the coolant, a stickiness of the coolant, or any other suitable parameter of the coolant indicative of the composition of the coolant. The CRD 252 may continue to operate until the parameter determined by the sensor 278 indicates the threshold level of the parameter has been achieved.

However, in certain embodiments, the CRD 252 may operate to replace substantially all of the coolant of the CDU 100 with new coolant from the coolant source 254. By way of example, the second CRD pump 260 may operate while operation of the first CRD pump 258 is suspended to drain existing coolant from the CDU 100 without introducing new coolant into the CDU 100. After the existing coolant has been drained from the CDU 100, the first CRD pump 258 may operate while operation of the second CRD pump 260 is suspended to direct new coolant into the CDU 100 to replace the existing coolant. As a result, new coolant may be directed into the CDU 100 without mixing with previous coolant circulating through the CDU 100 to fully replace the coolant supply of the CDU 100.

Although the present disclosure primarily discusses removability of the second pump 134 to swap the second pump 134 and the CRD 252 with one another, in certain embodiments, the first pump 132 may be removable from the CDU housing 104 to swap (e.g., hot swap) with the CRD 252. As an example, the first pump 132 may be removably coupled to the third coolant conduit 130 and may be interchangeable with the CRD 252. Thus, the CRD 252 may be used to replace either the second pump 134 or the first pump 132 to refresh the coolant supply in the CDU 100. In such embodiments, the second pump 134 or an additional CRD 252 positioned in the second slot 138 may operate during swapping between the first pump 132 and the CRD 252 in the first slot 136 to continue directing of coolant to cool the electrical component 102.

Figure 4:
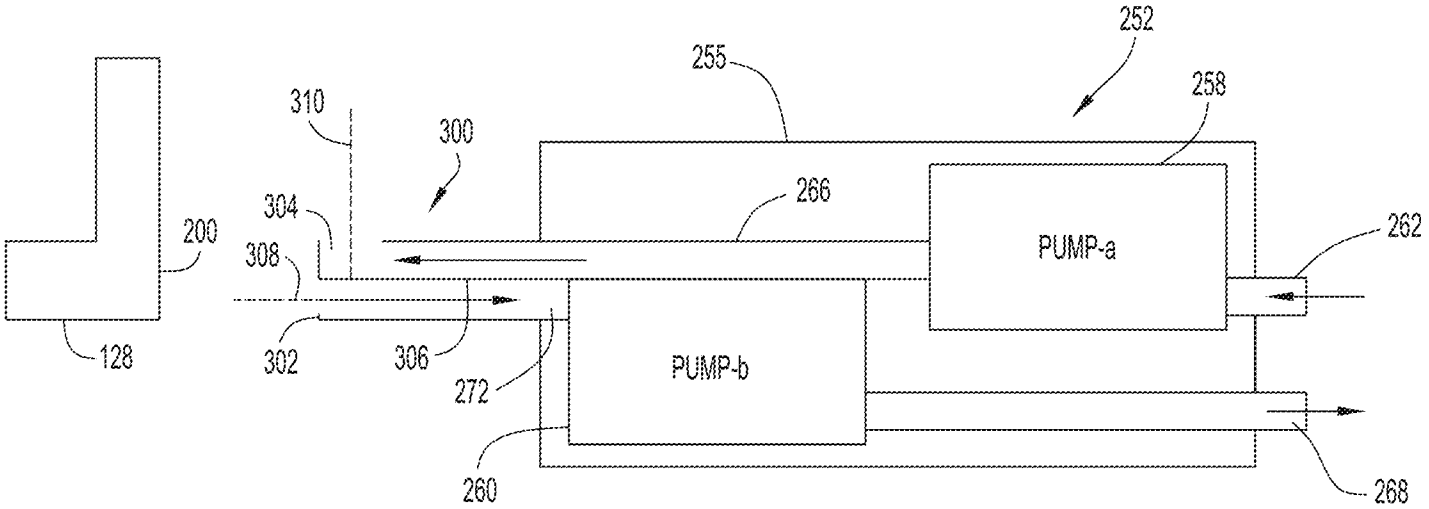
FIG. 4 is a schematic diagram of a coolant refresh device of a coolant distribution unit, according to an example embodiment.

FIG. 4 is a schematic diagram of the CRD 252 decoupled from the port 128 of the CDU 100, such as to transition the CDU 100 from the second configuration 250 to the first configuration 131. Decoupling of the CRD 252 from the port 128 may cause the wall 200 of the port 128 to move to block leakage of coolant from the port 128 (e.g., to arrange the CDU 100 in the configuration shown in FIG. 2). In the illustrated embodiment, the CRD 252 includes a CRD interface 300 extending from the CRD housing 255. The second CRD conduit 266 and the fourth CRD conduit 272 may extend to or at least partially through the CRD interface 300. The CRD interface 300 may be configured to be inserted into the port 128 (e.g., by moving the wall 200) to fluidly couple the second CRD conduit 266 and the fourth CRD conduit 272 to the port 128, thereby enabling the first CRD pump 258 and the second CRD pump 260 to direct coolant through the port 128. For example, the fourth CRD conduit 272 may be configured to receive coolant from the port 128 via a CRD inlet 302 of the CRD interface 300, and the second CRD conduit 266 may be configured to direct coolant to the port 128 via a CRD outlet 304 of the CRD interface 300. A CRD wall 306 may extend through the CRD interface 300 to separate the CRD inlet 302 and the CRD outlet 304 from one another, as well as to separate the second CRD conduit 266 and the fourth CRD conduit 272 from one another within the CRD interface 300.

A first axis 308 extends through a center of the cross-section of the CRD inlet 302 and a second axis 310 extends through a center of the cross-section of the CRD outlet 304. The first axis 308 and the second axis 310 may be oriented cross-wise (e.g., perpendicular or transverse) to one another to enable the second CRD conduit 266 to direct coolant to the coolant tank 106 via the CRD outlet 304 and to enable the fourth CRD conduit 272 to receive coolant from the heat exchanger 116 via the CRD inlet 302. However, it should be noted that the first axis 308 and the second axis 310 may be oriented in any suitable manner (e.g., extending parallel to one another), such as for a different arrangement of the coolant tank 106 and the heat exchanger 116 within the CDU housing 104.

In certain embodiments, a particular embodiment of the CRD 252 may be manufactured for implementation into a specific CDU 100. For instance, different CDUs 100 may have differently sized/shaped second slots 138. Thus, an embodiment of the CRD 252 having a CRD housing 255 sized/shaped to occupy the second slot 138 may be manufactured to enable positioning of the CRD 252 in the second slot 138. Thus, each CRD 252 may be dedicated for implementation in a particular CDU 100 to facilitate swapping with the second pump 134 of the particular CDU 100. In additional or alternative embodiments, the CRD 252 may be adjustable to enable implementation of the CRD 252 into different CDUs 100 that may have different configurations of the second slot 138. By way of example, the CRD housing 255 may be adjustable to occupy differently sized/shaped second slots 138 of different CDUs 100. As another example, operation of the first CRD pump 258 may be adjustable to direct coolant in different manners (e.g., at different flow rates, at different flow speeds, at different flow pressures) that may be suitable for different CDUs 100. As a further example, the CRD interface 300 of the CRD 252 may be adjustable (e.g., via adjustment of the second CRD conduit 266, via adjustment of the fourth CRD conduit 272) to enable connection to different arrangements of the port 128 of different CDUs 100. In this manner, a single, adjustable embodiment of the CRD 252 may be implemented in different embodiments of the CDU 100 to simplify manufacture of the CRD 252 (e.g., to avoid having to manufacture different embodiments of the CRD 252 that are each dedicated for implementation in a particular embodiment of the CDU 100 and not another embodiment of the CDU 100). Indeed, an existing CDU 100 may be retrofitted with the CRD 252 to achieve the benefits provided by the CRD 252, and the adjustability of the CRD 252 may enable the CRD 252 to be more readily implemented into the existing CDU 100.

Figure 5:
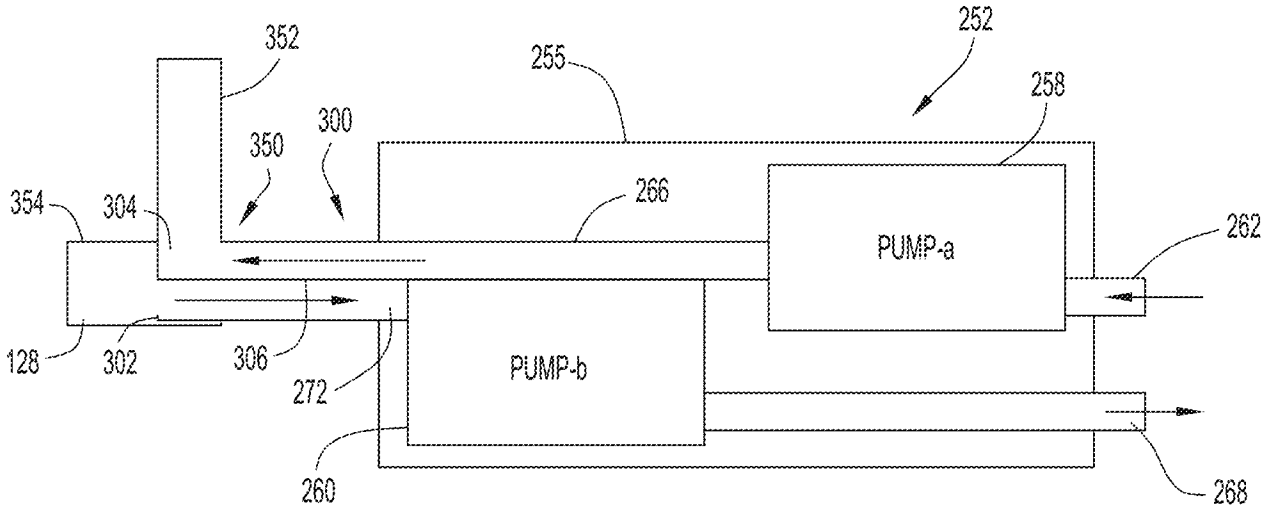
FIG. 5 is a schematic diagram of the coolant refresh device of FIG. 4 coupled to a port of a coolant distribution unit, according to an example embodiment.

FIG. 5 is a schematic diagram of the CRD 252 coupled to the port 128 of the CDU 100, such as in the second configuration 250. The CRD interface 300 may be inserted into the port 128, such as by moving the wall 200 to form an opening 350 of the port 128 through which the CRD interface 300 may extend. The CRD interface 300 may sealingly engage with the port 128 to block leakage of coolant out of the port 128 via the opening 350. Positioning of the CRD interface 300 in the port 128 may define a first chamber 352 and a second chamber 354 within the port 128. The CRD outlet 304 may be fluidly coupled to the first chamber 352, and the CRD inlet 302 may be fluidly coupled to the second chamber 354. Therefore, the first CRD pump 258 may be configured to direct coolant through the first chamber 352 toward the coolant tank 106 (e.g., and toward the electrical component 102), and the second CRD pump 260 may be configured to discharge coolant from the CDU 100 via the second chamber 354.

The CRD wall 306 may fluidly separate the first chamber 352 and the second chamber 354 from one another within the port 128. Thus, coolant flow directly between the first chamber 352 and the second chamber 354 may be blocked, thereby forcing coolant to flow from the first chamber 352 to the coolant tank 106 and from the second chamber 354 to the CRD 252. In this manner, undesirable discharge of new coolant resulting from direct flow from the second CRD conduit 266 to the fourth CRD conduit 272 may be discouraged, thereby improving efficiency of operation of the CRD 252 to refresh the coolant supply of the CDU 100.

Figure 6:
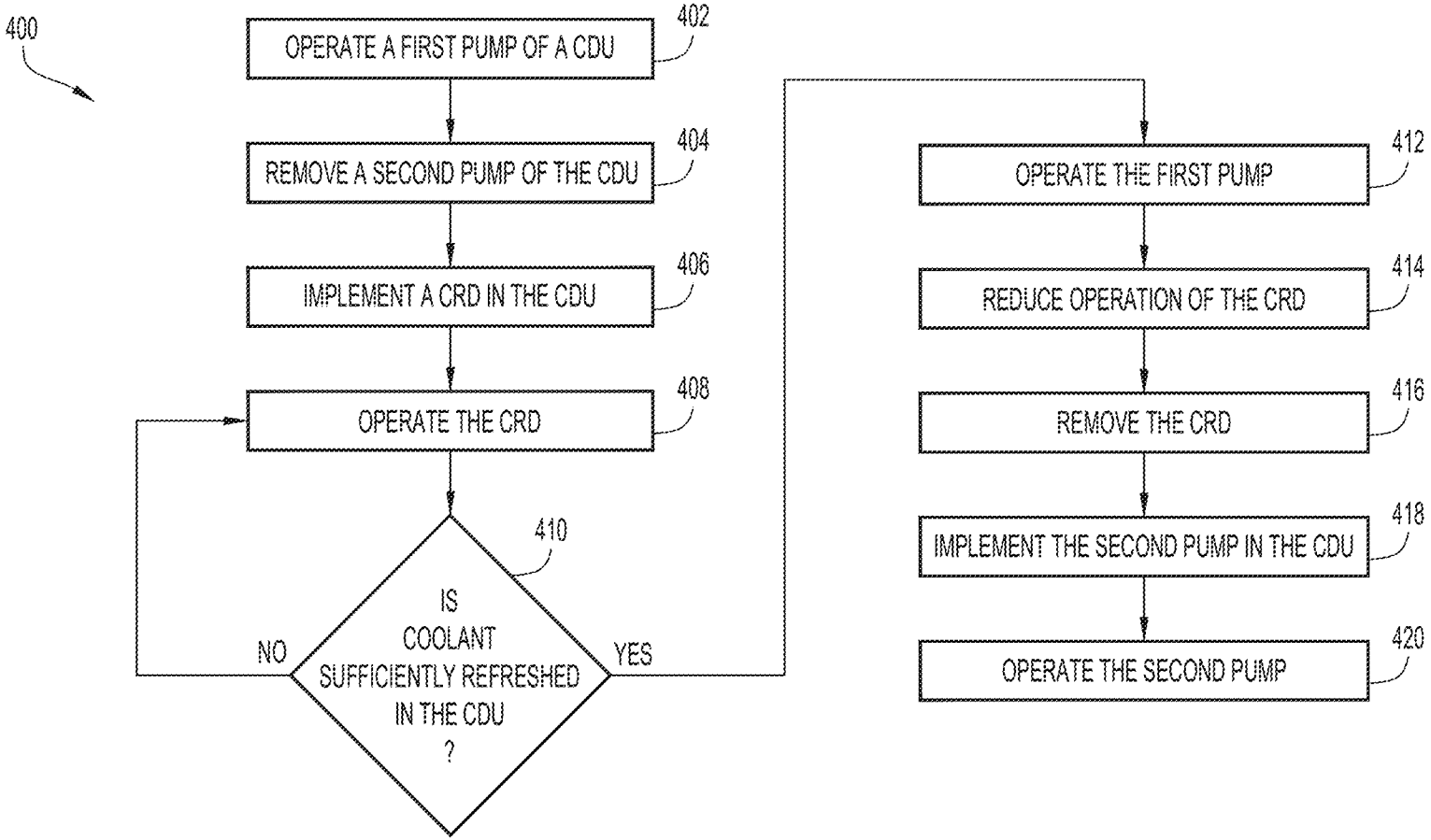
FIG. 6 is a flowchart of a method for transitioning a coolant distribution unit from a first configuration to a second configuration, according to an example embodiment.

FIG. 6 is a flowchart of a method 400 for uptime or hot swapping a pump (e.g., the second pump 134) of a CDU (e.g., the CDU 100) with a CRD (e.g., the CRD 252) while maintaining operation of the CDU to direct coolant to an additional component (e.g., the electrical component 102) to provide cooling. In other words, the method 400 may be performed to replace the pump with the CRD without occurrence of any downtime of the CDU (e.g., to hot swap the pump and the CRD). The operations of the method 400 may be performed by a single entity or by multiple entities, and at least a portion of the method 400 may be performed automatically (e.g., by a control system). It should be noted that the method 400 may be performed differently than depicted. For example, an additional operation may be performed, and/or any of the depicted operations may be performed differently, performed in a different order, and/or not performed.

At step 402, a first pump of the CDU may be operated to direct coolant from the CDU to the additional component. At step 404, a second pump may be removed from the CDU, such as from a housing of the CDU. For example, the second pump may be configured to couple to a port attached to a heat exchanger of the CDU, and the second pump may be decoupled from the port to be removed from the CDU. The second pump may also be configured to direct coolant from the CDU to the additional component while implemented in the CDU. However, operation of the second pump may be suspended to enable removal of the second pump. Thus, operation of the first pump while operation of the second pump is suspended (e.g., for removal from the CDU) may enable the CDU to continue to direct coolant from the CDU to the additional component.

At step 406, a CRD may be implemented in the CDU. By way of example, the housing of the CDU includes a slot configured to individually receive the second pump and the CRD. Thus, one of the second pump or the CRD may be positioned in the slot at a time for implementation in the CRD. The CRD may be coupled to the port attached to the heat exchanger upon positioning in the slot to complete installation.

At step 408, the CRD may be operated to direct coolant to the additional component. For example, a first CRD pump of the CRD may direct new coolant from a coolant source to the CDU for flow to the additional component. As such, operation of the first pump may be suspended or reduced while the CRD is in operation, and the CDU may continue to direct coolant to the additional component. Additionally, operation of the CRD may discharge coolant from the CDU via a second CRD pump of the CRD, such as from the heat exchanger to a coolant disposal location. As a result, operation of the CRD may replace old coolant previously circulating the CDU with new coolant from the coolant source to refresh the coolant supply of the CDU.

At step 410, a determination may be made regarding whether the coolant has been sufficiently refreshed in the CDU. In response to a determination that the coolant has not been sufficiently refreshed, operation of the CRD may continue. In some embodiments, the determination may be based on a duration of operation of the CRD. For example, a determination may be made that the coolant has not been sufficiently refreshed based on the duration of operation of the CRD being below a threshold duration. In additional or alternative embodiments, the determination may be based on a parameter of the coolant circulating through the CDU. For instance, the parameter (e.g., a transparency, a stickiness) may be indicative of the composition (e.g., chemical composition), such as the purity, of the coolant and may be determined by a sensor for comparison with a threshold level or value. A determination may be made that the coolant has not been sufficiently refreshed based on the parameter failing to reach the threshold level.

At step 412, in response to a determination that the coolant has been sufficiently refreshed in the CDU, the CDU may be prepared for removal by operating the first pump again to direct coolant to the additional component. For example, the determination may be made based on the duration of operation of the CRD reaching the threshold duration and/or the determined parameter of the coolant reaching the threshold level. At step 414, operation of the CRD may be reduced (e.g., suspended) to enable the CRD to be removed. Consequently, at this time, operation of the first pump, rather than of the CRD, may cool the additional component.

At step 416, the CRD may be removed, such as by decoupling the CRD from the port attached to the heat exchanger and then removing the CRD from the slot in the housing. At step 418, the second pump may be implemented in the CDU, such as by positioning the second pump in the slot and coupling the second pump to the port. At step 420, the second pump may be operated to direct coolant from the CDU to the additional component. In some embodiments, operation of the first pump may be reduced or suspended such that the second pump primarily operates to direct coolant from the CDU to the additional component. For example, reducing or suspending operation of the first pump may reduce power consumption to reduce an overall cost associated with operating the CDU.

Operations similar to the method 400 may also be performed to swap the CRD and the first pump in certain embodiments. Indeed, either or both of the pumps of the CDU may be replaced with the CRD while maintaining operation of the CDU to direct coolant to the additional component, thereby continually cooling the additional component even while one of the pumps of the CDU and/or the CRD may not be in operation.

In some aspects, the techniques described herein relate to an apparatus including: a housing of a coolant distribution unit; a pump of the coolant distribution unit, wherein the pump is configured to circulate coolant between the coolant distribution unit and an external component; and a coolant refresh device of the coolant distribution unit, wherein the coolant refresh device is configured to direct coolant from a coolant source into the coolant distribution unit and to discharge coolant out of the coolant distribution unit, and the pump and the coolant refresh device are interchangeably implementable in the housing such that the pump and the coolant refresh device are configured to swap and replace one another in the housing to install one of the pump or the coolant refresh device in the housing at a time.

In some aspects, the techniques described herein relate to an apparatus, wherein the housing includes a slot configured to individually receive the pump and the coolant refresh device to interchangeably implement the pump and the coolant refresh device in the housing.

In some aspects, the techniques described herein relate to an apparatus, wherein the coolant refresh device includes: a coolant refresh device housing; a first coolant refresh device pump disposed in the coolant refresh device housing, wherein the first coolant refresh device pump is configured to direct coolant from the coolant source into the coolant distribution unit; and a second coolant refresh device pump disposed in the coolant refresh device housing, wherein the second coolant refresh device pump is configured to discharge coolant out of the coolant distribution unit.

In some aspects, the techniques described herein relate to an apparatus, further including a heat exchanger of the coolant distribution unit, wherein the heat exchanger is disposed in the housing and is configured to change a temperature of coolant in the coolant distribution unit, and the coolant refresh device is configured to discharge coolant from the heat exchanger out of the coolant distribution unit.

In some aspects, the techniques described herein relate to an apparatus, further including a port of the coolant distribution unit, wherein the port is fluidly coupled to the heat exchanger, and the pump and the coolant refresh device are configured to interchangeably couple to the port to be interchangeably implementable in the housing.

In some aspects, the techniques described herein relate to an apparatus, wherein the coolant refresh device includes an interface configured to couple to the port to define a first chamber and a second chamber in the port, the coolant refresh device is configured to direct coolant to the external component via the first chamber, and the coolant refresh device is configured to receive coolant from the heat exchanger via the second chamber.

In some aspects, the techniques described herein relate to an apparatus, further including a tank and an outlet of the coolant distribution unit, wherein the tank and the outlet are fluidly coupled to one another, the outlet is configured to direct coolant to the external component, and the coolant refresh device is configured to direct coolant to the tank via the first chamber to direct coolant from the coolant source to the external component via the outlet.

In some aspects, the techniques described herein relate to an apparatus, including an additional pump of the coolant distribution unit, wherein the additional pump is configured to circulate coolant between the coolant distribution unit and the external component while operation of the pump and/or of the coolant refresh device is suspended.

In some aspects, the techniques described herein relate to an apparatus including: a first pump of a coolant distribution unit, wherein the first pump is configured to circulate coolant between the coolant distribution unit and an additional component; a second pump of the coolant distribution unit, wherein the second pump is configured to circulate coolant between the coolant distribution unit and the additional component; and a coolant refresh device of the coolant distribution unit, wherein the coolant refresh device is configured to direct coolant into the coolant distribution unit and discharge coolant out of the coolant distribution unit, the coolant refresh device and the second pump are interchangeably hot swappable in the coolant distribution unit to replace one another in the coolant distribution unit and install one of the second pump or the coolant refresh device in the coolant distribution unit at a time, and the first pump is configured to operate to circulate coolant between the coolant distribution unit and the additional component during replacement of the second pump and of the coolant refresh device.

In some aspects, the techniques described herein relate to an apparatus, further including a port of the coolant distribution unit, wherein the coolant refresh device and the second pump are configured to interchangeably couple to the port to be interchangeably hot swappable in the coolant distribution unit.

In some aspects, the techniques described herein relate to an apparatus, wherein the coolant refresh device is configured to couple to the port to define a first chamber and a second chamber that are fluidly separate from one another within the port, the coolant refresh device is configured to direct coolant through the first chamber to the additional component, and the coolant refresh device is configured to direct coolant from the second chamber out of the coolant distribution unit.

In some aspects, the techniques described herein relate to an apparatus, further including an outlet of the coolant distribution unit, wherein the outlet is configured to direct coolant to the additional component, and each of the second pump and the coolant refresh device is configured to direct coolant to the additional component via the outlet.

In some aspects, the techniques described herein relate to an apparatus, further including a heat exchanger of the coolant distribution unit, wherein the heat exchanger is configured to change a temperature of coolant in the coolant distribution unit, and each of the first pump, the second pump, and the coolant refresh device is configured to direct coolant from the heat exchanger to the outlet.

In some aspects, the techniques described herein relate to an apparatus, wherein the coolant refresh device includes an additional outlet configured to discharge the coolant from the coolant distribution unit.

In some aspects, the techniques described herein relate to an apparatus, further including a tank of the coolant distribution unit, wherein the tank is fluidly coupled to the outlet, and each of the first pump, the second pump, and the coolant refresh device is configured to direct coolant to the tank to direct coolant to the additional component via the outlet.

In some aspects, the techniques described herein relate to an apparatus, further including a first inlet of the coolant distribution unit, wherein the first inlet is configured to receive coolant from the additional component, and the coolant refresh device includes a second inlet configured to receive coolant from a coolant source to direct coolant into the coolant distribution unit.

In some aspects, the techniques described herein relate to an apparatus, wherein the coolant refresh device includes: a third pump configured to direct coolant into the coolant distribution unit; and a fourth pump configured to discharge coolant out of the coolant distribution unit.

In some aspects, the techniques described herein relate to an apparatus including: an interface of a coolant refresh device, wherein the interface is configured to couple to a port of a coolant distribution unit to define a first chamber and a second chamber within the port; a first pump of the coolant refresh device, wherein the first pump is configured to direct coolant from a coolant source, through the coolant distribution unit, and to an additional component via the first chamber; and a second pump of the coolant refresh device, wherein the second pump is configured to discharge coolant from the coolant distribution unit via the second chamber.

In some aspects, the techniques described herein relate to an apparatus, wherein the interface includes: an outlet fluidly coupled to the first chamber of the port, wherein the first pump is configured to direct coolant from the coolant source into the first chamber via the outlet to direct coolant from the coolant source, through the coolant distribution unit, and to the additional component via the first chamber; and an inlet fluidly coupled to the second chamber of the port, wherein the second pump is configured to receive coolant from the second chamber via the inlet to discharge coolant from the coolant distribution unit via the second chamber.

In some aspects, the techniques described herein relate to an apparatus, further including: a housing of the coolant refresh device, wherein the first pump and the second pump are disposed in the housing; an inlet of the coolant refresh device, wherein the first pump is configured to receive coolant from the coolant source via the inlet to direct coolant from the coolant source, through the coolant distribution unit, and to the additional component; and an outlet of the coolant refresh device, wherein the second pump is configured to discharge coolant from the coolant distribution unit via the outlet to discharge coolant from the coolant distribution unit.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

As used herein, unless expressly stated to the contrary, use of the phrase 'at least one of', 'one or more of', 'and/or', variations thereof, or the like are open-ended expressions that are both conjunctive and disjunctive in operation for any and all possible combination of the associated listed items. For example, each of the expressions 'at least one of X, Y and Z', 'at least one of X, Y or Z', 'one or more of X, Y and Z', 'one or more of X, Y or Z' and 'X, Y and/or Z' can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Note that in this Specification, references to various features (e.g., elements, structures, nodes, modules, components, engines, logic, steps, operations, functions, characteristics, etc.) included in 'one embodiment', 'example embodiment', 'an embodiment', 'another embodiment', 'certain embodiments', 'some embodiments', 'various embodiments', 'other embodiments', 'alternative embodiment', and the like are intended to mean that any such features are included in one or more embodiments of the present disclosure, but may or may not necessarily be combined in the same embodiments.

Each example embodiment disclosed herein has been included to present one or more different features. However, all disclosed example embodiments are designed to work together as part of a single larger system or method. This disclosure explicitly envisions compound embodiments that combine multiple previously-discussed features in different example embodiments into a single system or method.

Additionally, unless expressly stated to the contrary, the terms 'first', 'second', 'third', etc., are intended to distinguish the particular nouns they modify (e.g., element, condition, node, module, activity, operation, etc.). Unless expressly stated to the contrary, the use of these terms is not intended to indicate any type of order, rank, importance, temporal sequence, or hierarchy of the modified noun. For example, 'first X' and 'second X' are intended to designate two 'X' elements that are not necessarily limited by any order, rank, importance, temporal sequence, or hierarchy of the two elements. Further as referred to herein, 'at least one of' and 'one or more of' can be represented using the '(s)' nomenclature (e.g., one or more element(s)).

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

The techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

One or more advantages described herein are not meant to suggest that any one of the embodiments described herein necessarily provides all of the described advantages or that all the embodiments of the present disclosure necessarily provide any one of the described advantages. Numerous other changes, substitutions, variations, alterations, and/or modifications may be ascertained to one skilled in the art and it is intended that the present disclosure encompass all such changes, substitutions, variations, alterations, and/or modifications as falling within the scope of the appended claims.

What is claimed is:

1. An apparatus comprising:

a housing of a coolant distribution unit;

a coolant tank of the coolant distribution unit, wherein the coolant tank is configured to store coolant and direct coolant to an external component; and a coolant refresh device of the coolant distribution unit, wherein the coolant refresh device comprises a first coolant refresh device pump configured to direct coolant from a coolant source into the coolant tank and a second coolant refresh device pump configured to discharge coolant out of the coolant distribution unit.

2. The apparatus of claim 1, wherein the housing comprises a slot configured to receive the coolant refresh device.

3. The apparatus of claim 1, further comprising a heat exchanger of the coolant distribution unit, wherein the heat exchanger is disposed in the housing and is configured to change a temperature of coolant in the coolant distribution unit, and the second coolant refresh device pump of the coolant refresh device is configured to discharge coolant from the heat exchanger out of the coolant distribution unit.

4. The apparatus of claim 3, further comprising a port of the coolant distribution unit, wherein the port is fluidly coupled to the heat exchanger, and the coolant refresh device is configured to couple to the port.

5. The apparatus of claim 4, wherein the coolant refresh device comprises an interface configured to couple to the port to define a first chamber and a second chamber in the port, the first coolant refresh device pump of the coolant refresh device is configured to direct coolant to the coolant tank via the first chamber, and the second coolant refresh device pump of the coolant refresh device is configured to receive coolant from the heat exchanger via the second chamber.

6. The apparatus of claim 3, wherein the heat exchanger is configured to receive coolant from the external component.

7. The apparatus of claim 1, further comprising an outlet of the coolant distribution unit, wherein the coolant tank and the outlet are fluidly coupled to one another, and the coolant tank is configured to direct coolant to the external component via the outlet.

8. The apparatus of claim 7, further comprising an additional outlet, separate from the outlet, wherein the second coolant refresh device pump of the coolant refresh device is configured to discharge coolant out of the coolant distribution unit via the additional outlet.

9. The apparatus of claim 1, comprising a pump of the coolant distribution unit, wherein the pump is configured to circulate coolant between the coolant distribution unit and the external component while operation of the coolant refresh device is suspended.

10. An apparatus comprising:

a first pump of a coolant distribution unit, wherein the first pump is configured to circulate coolant between the coolant distribution unit and an additional component; and a coolant refresh device of the coolant distribution unit, wherein the coolant refresh device is configured to direct coolant into the coolant distribution unit and discharge coolant out of the coolant distribution unit, and the first pump is configured to operate to circulate coolant between the coolant distribution unit and the additional component while operation of the coolant refresh device is suspended.

11. The apparatus of claim 10, further comprising a port of the coolant distribution unit, wherein the coolant refresh device is configured to couple to the port.

12. The apparatus of claim 11, wherein the coolant refresh device is configured to couple to the port to define a first chamber and a second chamber that are fluidly separate from one another within the port, the coolant refresh device is configured to direct coolant through the first chamber to the additional component, and the coolant refresh device is configured to direct coolant from the second chamber out of the coolant distribution unit.

13. The apparatus of claim 10, further comprising an outlet of the coolant distribution unit, wherein the outlet is configured to direct coolant to the additional component, and the coolant refresh device is configured to direct coolant to the additional component via the outlet.

14. The apparatus of claim 13, further comprising a heat exchanger of the coolant distribution unit, wherein the heat exchanger is configured to change a temperature of coolant in the coolant distribution unit, and the first pump is configured to direct coolant from the heat exchanger to the outlet.

15. The apparatus of claim 14, further comprising an additional outlet of the coolant distribution unit, wherein the additional outlet is configured to direct coolant out of the coolant distribution unit, and the coolant refresh device is configured to direct coolant from the heat exchanger to the additional outlet.

16. The apparatus of claim 13, further comprising a tank of the coolant distribution unit, wherein the tank is fluidly coupled to the outlet, and each of the first pump and the coolant refresh device is configured to direct coolant to the tank to direct coolant to the additional component via the outlet.

17. The apparatus of claim 10, further comprising a first inlet of the coolant distribution unit, wherein the first inlet is configured to receive coolant from the additional component, and the coolant refresh device comprises a second inlet configured to receive coolant from a coolant source to direct coolant into the coolant distribution unit.

18. The apparatus of claim 10, wherein the coolant refresh device comprises:

a second pump configured to direct coolant into the coolant distribution unit; and a third pump configured to discharge coolant out of the coolant distribution unit.

19. A coolant distribution unit comprising:

a housing;

a coolant refresh device configured to direct coolant from a coolant source into the coolant distribution unit and to discharge coolant out of the coolant distribution unit so as to circulate coolant between the coolant distribution unit and an external component;

a heat exchanger disposed in the housing and configured to change a temperature of coolant; and a port fluidly coupled to the heat exchanger, wherein the coolant refresh device comprises an interface configured to couple to the port to define a first chamber and a second chamber in the port such that the coolant refresh device is configured to direct coolant to the external component via the first chamber and to receive coolant from the heat exchanger via the second chamber, and wherein the coolant refresh device is configured to discharge coolant from the heat exchanger out of the coolant distribution unit.

20. The coolant distribution unit of claim 19, wherein the housing comprises a slot configured to receive the coolant refresh device, and the coolant refresh device is removable from the slot.

* * * * *